United States Patent [19]

Jackson

[11] 4,118,966

[45] Oct. 10, 1978

[54] TOOL FOR WALL ANCHORS

[75] Inventor: Ewart William Jackson, Southall, England

[73] Assignee: Futters (London) Limited, London, England

[21] Appl. No.: 807,684

[22] Filed: Jun. 17, 1977

[30] Foreign Application Priority Data

Jun. 17, 1976 [GB] United Kingdom ..... 25233/76

[51] Int. Cl.[2] ..... B21J 15/34

[52] U.S. Cl. ..... 72/114; 72/409; 72/452

[58] Field of Search ..... 72/114, 391, 452, 409, 72/410; 81/347, 355; 30/252, 192

[56] References Cited

U.S. PATENT DOCUMENTS

| | | | |
|---|---|---|---|
| 1,829,696 | 10/1931 | Wylie | 72/391 |
| 2,399,442 | 4/1946 | Luce | 72/391 |
| 2,428,458 | 10/1947 | Hollwarth | 72/391 |
| 2,582,417 | 1/1952 | Croessant | 72/391 |

*Primary Examiner*—Milton S. Mehr
*Assistant Examiner*—Gene P. Crosby
*Attorney, Agent, or Firm*—Oblon, Fisher, Spivak, McClelland & Maier

[57] ABSTRACT

A tool for deforming wall anchors is disclosed. The tool is provided with a head, and a pair of elongated handles pivotally extend from the head. A profile follower is sandwiched between the handles to move linearly relative to the head in response to pivotal movement of the pivoted handles. An operating member is movable with the follower to deform a wall anchor attached to the operating member.

17 Claims, 5 Drawing Figures

TOOL FOR WALL ANCHORS

BACKGROUND OF THE INVENTION

The present invention relates to tools for exerting a compressive or tensile force and has particular, but not exclusive, application to tools for deforming so-called "wall anchors".

DESCRIPTION OF THE PRIOR ART

Wall anchors are permanently deformable self-anchoring fasteners for threaded members such as bolts and screws, which fasteners can be inserted into a hole in a support member from one side thereof to extend therethrough and can subsequently be deformed from such side to be anchored in the support member. The wall anchor can usually be so deformed by screwing the bolt or screw into the anchor from such side of the support member. However, professional users of wall anchors rely upon the use of tools to exert an axially compressive force on the anchor to deform it.

At the present time, there are several wall-anchor deforming tools available commercially. To the best of applicant's knowledge, they all operate with a substantially constant mechanical advantage whereby there exists a significant risk of pulling the anchor through the support member; it will be appreciated that, in most applications, the deformation of the wall anchor cannot be viewed.

SUMMARY OF THE INVENTION

It is an object of this invention to provide a tool which can be readily adapted to constitute an improved wall-anchor deforming tool. In particular, it is an object to provide such a deforming tool which is relatively inexpensive to manufacture, easy and quick to use and has a decreasing mechanical advantage as the extremity of deformation movement is reached.

According to the present invention, there is provided a tool comprising a head, a pair of elongate handles extending from the head, at least one of said handles being pivoted to the head, a profile follower sandwiched between the said handles to move linearly relative to the head in response to pivotal movement of the said pivoted handle(s), and an operating member movable with said follower.

As mentioned previously, the invention has particular application to the deformation of wall anchors and it is preferred therefore that the tool be adapted for that purpose. It will be appreciated, however, that the tool can be adapted for other uses. For example, the operating member can be provided with a jaw which cooperates with the head to grip objects therebetween whereby the tool can be adapted for use as, for example, pincers or nut-crackers.

Preferably, the head is adapted to abut a planar surface such as a wall partition in a building. For example, the head can have a planar outer face or a spaced pair of support arms for this purpose. Suitably, such face is a plate having an orifice aligned with the direction of movement of the operating member and providing access to or for such member. Advantageously, the plate has two or more orifices of different dimensions and is movable to selectively align any orifice with said direction of movement.

It is also preferred that the head includes a linear guide member defining the direction of movement of the follower and operating member. Conveniently, the member can be a spaced pair of plates depending from the head to constrain movement of the follower laterally of the handles, at least one of the plates having a guide slot extending therein to receive a projection of the follower.

The handles are preferably both pivoted to the head but for certain applications it may be desired to have one of the handles rigid with the head. The handles are shaped having regard to the nature of the movement of be imparted to the follower. For example, they may be shaped to provide a change in mechanical advantage during movement of the follower between its extremities. A decrease in mechanical advantage is of considerable assistance when deforming wall anchors. Suitably, the handles each have a preferably straight hand grip portion and a straight follower-abutting portion inclined inwardly (with respect to the follower) from the hand grip portion. More complicated profiles can be provided on the follower-abutting portion if required.

The follower conveniently is a cylindrical member of, for example, low friction material such as plastics. The handles act on the circumferential surface of the member to induce the desired linear movement.

The operating member preferably is a rigid bar, especially a rod and more especially a threaded rod, extending from the follower for linear movement therewith. Usually, the bar extends through the head of the tool in both extremities of movement thereof but other arrangements can readily be adopted if desired.

The configuration of the tool is preferably such that it exerts a compressive force towards the head on operative movement of the handle(s). It will be appreciated however that the tool can readily be arranged to exert a tensile force away from the head.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
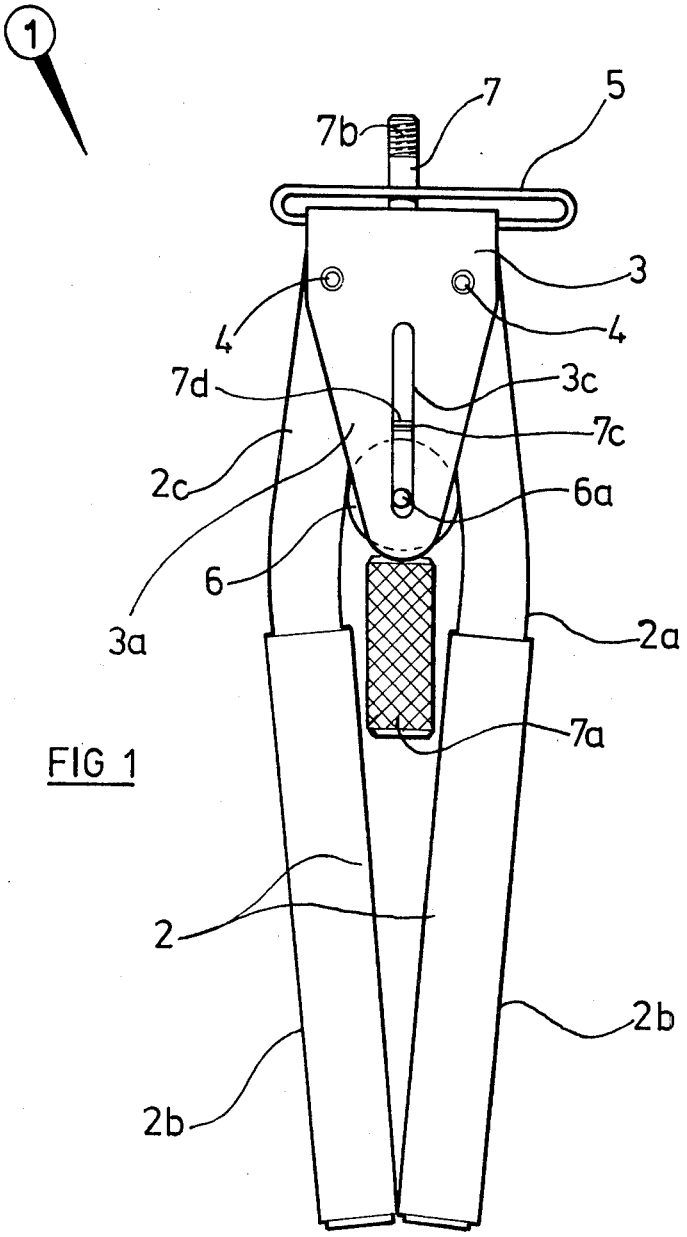
FIG. 1 is a view from one side of a wall anchor deforming tool in its closed condition.

Referring to the drawings, a tool generally indicated at 1 is specifically adapted to deform wall anchors. The tool comprises a pair of tubular handles 2 each pivotally attached to a head 3 by means of respective pivot pins 4.

The handles 2 have a straight grip portion **2*a* extending to their respective distal end and covered with a sleeve. The proximal portion 2*c* of the respective handles is inclined inwardly to provide a straight cam surface facing the other handle. Conveniently, the handle portions 2*a*, 2*c* are formed of cylindrical metal tubing and the sleeves 2*b*** are made of plastics material.

The head 3 has a pair of mutually opposed side plates *3a* which depend from a cross-member *3b*. Each side plate has an elongate guide slot *3c* and, as shown, the two slots *3c* can be of different dimensions. A slider 5 is mounted on the cross-member *3b* and is slidable thereon to selectively align any one of two holes *5a* therein with a hole *3d* in cross-member *3b*. Conveniently head 3 and slider 5 can be made of sheet metal and the plates *3a* have sufficient resilience to permit of insertion and removal of a follower 6 as described below.

The follower 6 is a solid cylindrical member of plastics or other low friction material and is adapted to slide between the plates *3a*. An axial projection *6a* is provided on one side to be received in one of the slots *3c*. A rod 7 of, for example, metal, is rotatably received in a diagonal bore in and extends diagonally upwardly from the follower 6. The rod 7 has knurled knob *7a* at its lower end and is threaded at its upper end *7b*. A circlip *7c* extends in a circumferentially extending groove *7d* to limit axial movement of the rod 7. The rod extends upwardly through aligned holes *3d, 5a*. The size of the rod and pitch of the thread thereof are selected with regard to the wall anchor to be deformed. Several rods can be provided with the same tool to facilitate deformation of a range of wall anchor sizes and types. Conveniently, each rod is provided with its own follower 6 and the slot *3c*, in which the respective projection *6a* will engage, will be chosen with regard to the length of travel required for the selected rod and follower unit.

Figure 2:
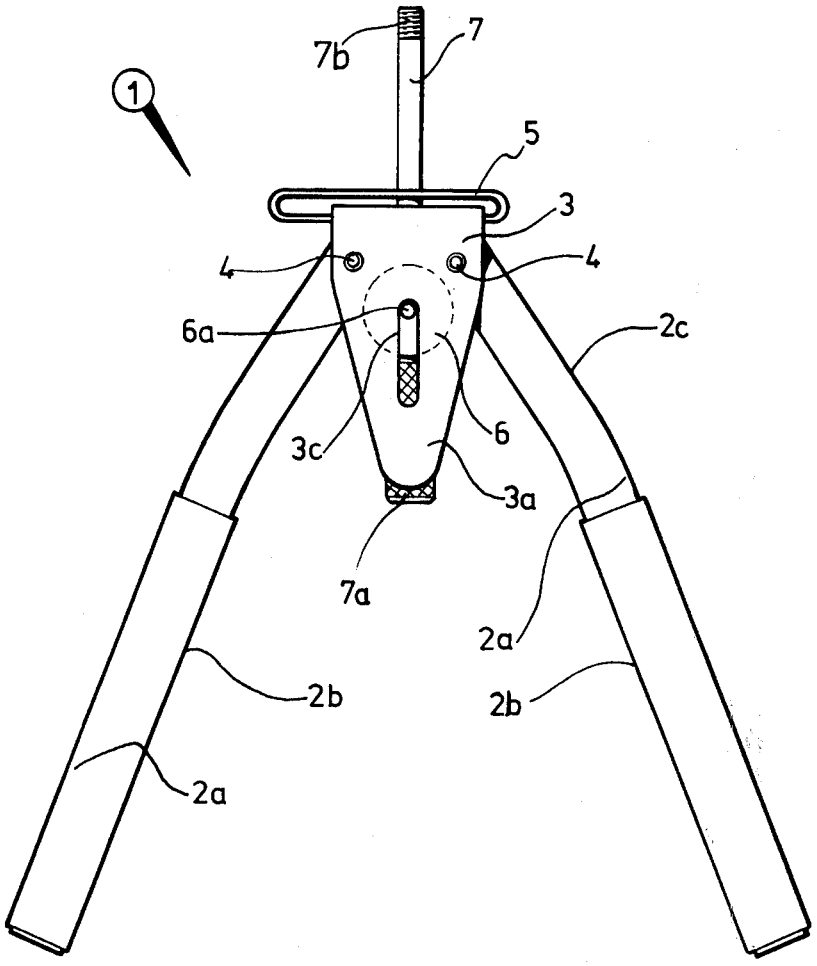
FIG. 2 is a view from the opposite side of the tool of FIG. 1 in its open condition.
Figure 3:
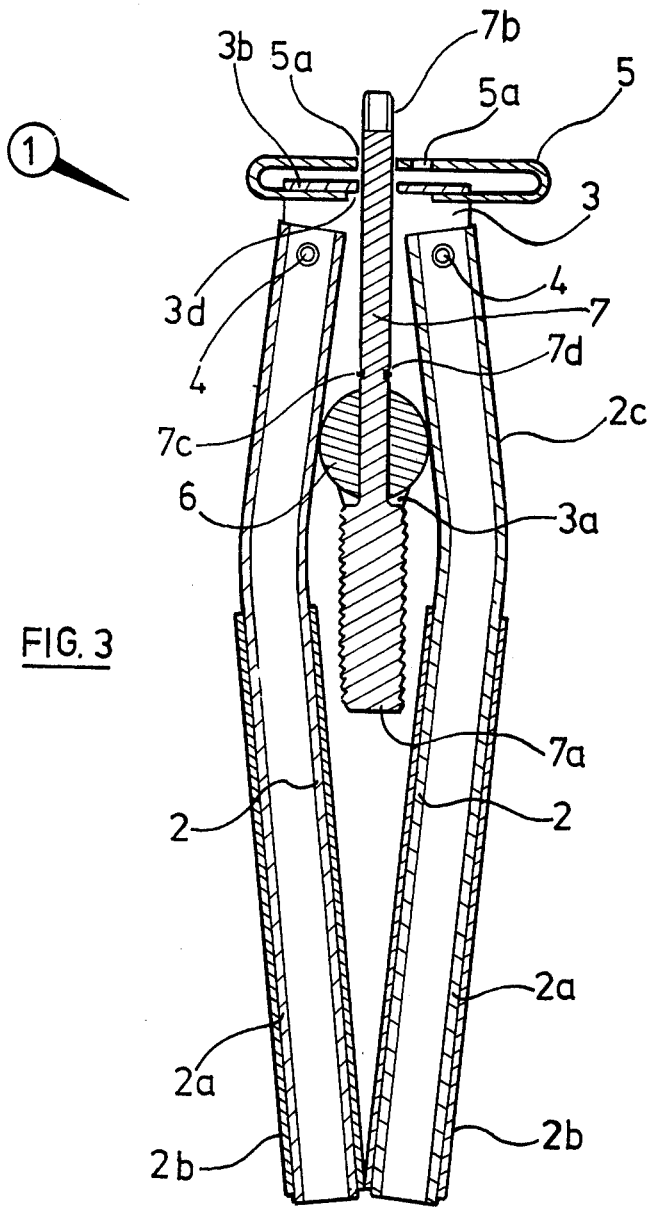
FIG. 3 is a cross-sectional view corresponding to FIG. 1.

In use, an appropriately sized rod 7 and follower 6 unit is selected for a wall anchor 10 and is inserted into the tool 1 by urging the plates *3a* apart at their distal ends. The rod 7 thus inserted in the tool 1 is passed axially into the wall anchor 10 and the rod 7 twisted by means of knob *7a* about its axis to threadably engage the rod in the screw-retaining internally threaded end portion 14 of the anchor. The anchor 10 is then inserted into a hole 11 drilled or otherwise formed in a support member 12, for example a wall partition. Conventionally a flange 13 or other projection prevents the wall anchor from passing completely through the hole. The outer face of slider 5 is then placed flat against the flange 13 to sandwich it between the slider 5 and the support member 12, in which position the follower 6 causes the handles 2 to be spaced apart. This open position of the tool is shown in FIG. 2 and the undeformed state of the wall anchor is shown in FIG. 4.

The handles 2 are then pushed together whereby the cam portions *2c* act on the circumference of the follower 6 to force it away from the slider 5 in the axial direction of the rod 7. This movement applies an axially compressive force on the wall anchor 10 causing it to deform. Deformation is continued until deformed legs 15 of the anchor abut the rear surface of the support member 12 thereby anchoring the wall anchor in the hole (see FIG. 5). The mechanical advantage of the tool decreases as the handles are moved together whereby the risk of pulling the anchor 10 through the support member 12 is reduced. The knob *7a* is then twisted to disengage the rod 7 from the anchor 10 and make the tool available for reuse.

The rod 7 and the follower 6 unit can be retained in the tool until a different size of unit is required, whence the unit can be removed by urging apart the distal ends of plates *3a*. If necessary, the slider 5 is moved to align the other hole *5a* with hole *3d* to restrict lateral movement of the replacement rod 7 and to prevent the flange 13 passing through the slider.

Figure 4:
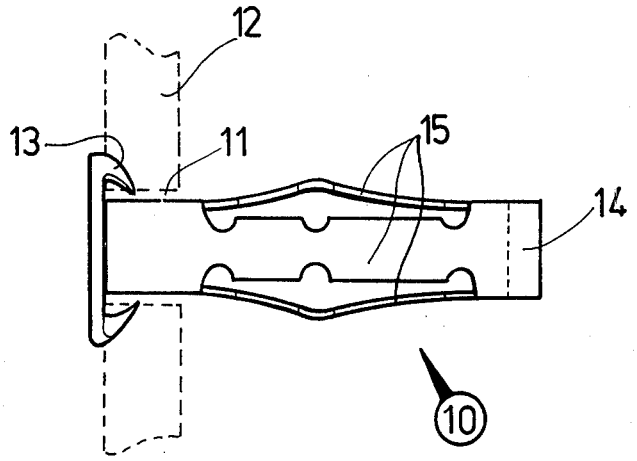
FIG. 4 is a side view of a wall anchor before deformation.
Figure 5:
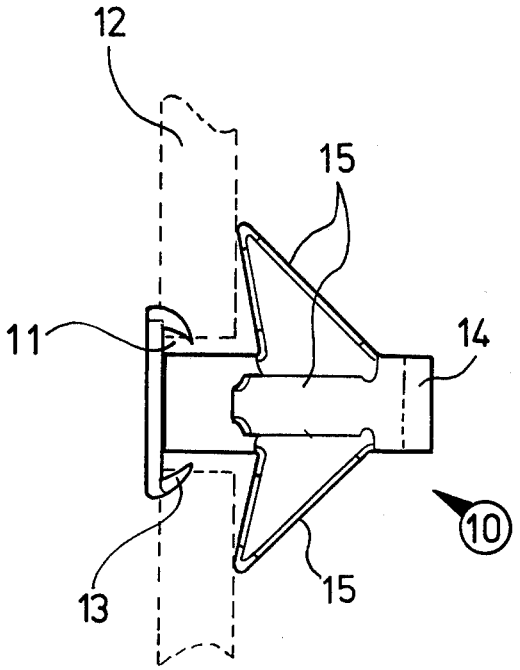
FIG. 5 is a side view of the anchor of FIG. 4 after deformation.

The wall anchor shown in FIGS. 4 and 5 is claimed in our copending United Kingdom Patent Application No. 9330/76.

It will be appreciated that the invention is not restricted to the details described above but that numerous modifications and variations can be made without departing from the scope of the invention claimed in the following Claims. In particular, a jaw could be threadably received on rod 7 to permit use of the tool 1 as pincers or as a nut-cracker.

What is claimed as new and desired to be secured by Letters Patent of the United States is:

1. A tool which comprises:

a head;

a pair of elongate handles extending from the head, at least one of said handles being pivoted to the head and each handle having an elongate follower-abutting surface;

a profile follower for said surfaces, which follower moves linearly relative to the head in response to the handles being pressed together to sandwich the follower between their respective follower-abutting surfaces; and an operating member movable with said follower.

2. A tool as claimed in claim 1 wherein the profile follower is a cylindrical member and the handles act on the circumferential surface of said member to induce the desired linear movement.

3. A tool as claimed in claim 1 wherein the operating member is a rod extending from the follower for linear movement therewith.

4. A tool as claimed in claim 1 adapted to exert a compressive force towards the head on operative movement of the handles.

5. A tool as claimed in claim 1 which is adapted for the deformation of wall anchors.

6. A tool as defined in claim 5 wherein the head is adapted to abut a planar surface.

7. A tool as claimed in claim 6 wherein the head has a planar outer face.

8. A tool as claimed in claim 7 wherein the said outer face is a plate having an orifice aligned with the direction of movement of the operating member and providing access to or for said member.

9. A tool as claimed in claim 8 wherein the said plate has two or more orifices of different dimensions and is movable to selectively align any orifice with the said direction of movement.

10. A tool as claimed in claim 1 wherein the head includes linear guide means defining the direction of movement of the follower and operating member.

11. A tool as claimed in claim 10 wherein the said linear guide means comprise a pair of side plates depending from the head to constrain movement of the follower laterally of the handles, at least one of said plates having a guide slot extending therein to receive a projection of said follower.

12. A tool as claimed in claim 1 wherein both handles are pivoted to the head.

13. A tool as claimed in claim 1 wherein the handles are shaped to provide a decrease in mechanical advantage during movement of the follower between its extremities.

14. A tool as claimed in claim 13 wherein the handles each have a hand grip portion and a straight follower-abutting portion inclined inwardly.

15. A tool adapted for deformation of wall anchors which comprises:

a head adapted to abut a planar surface having a planar outer face comprising a plate;

a pair of elongate handles extending from the head, at least one of said handles being pivoted to the head;

a profile follower sandwiched between the said handles to move linearly relative to the head in response to pivotal movement of the said at least one pivoted handle; and an operating member movable with said follower, the said plate having two or more orifices of different dimensions and being movable to selectively align any orifice with the direction of movement of the operating member to provide access to or for said member.

16. A tool which comprises:

a head, a pair of elongate handles extending from the head, at least one of said handles being pivoted to the head;

a profile follower sandwiched between the handles to move linearly relative to the head in response to pivotal movement of said at least one handle, and an operating member movable with said follower, the said head including linear guide means defining the direction of movement of the follower and operating member comprising a pair of side plates depending from the head to constrain movement of the follower laterally of the handles, at least one of said plates having a guide slot extending therein to receive a projection of the follower.

17. A tool which comprises:

a head;

a pair of elongate handles extending from the head, at least one of said handles being pivoted to the head, a cylindrical profile follower sandwiched between the handles whereby the handles act on the circumferential surface of the follower to move the follower linearly relative to the head in response to pivotal movement of said at least one handle; and an operating member movable with said follower.

* * * * *